US007752809B2

(12) United States Patent
Di Vinadio

(10) Patent No.: US 7,752,809 B2
(45) Date of Patent: Jul. 13, 2010

(54) DRIVE ASSEMBLY FOR DOOR AND WINDOW FRAMES

(75) Inventor: Aimone Balbo Di Vinadio, Chiusa San Michele (IT)

(73) Assignee: SAVIO S.p.A., Chiusa San Michele (Turin) (IT)

( * ) Notice: Subject to any disclaimer, the term of this patent is extended or adjusted under 35 U.S.C. 154(b) by 441 days.

(21) Appl. No.: 11/759,107

(22) Filed: Jun. 6, 2007

(65) Prior Publication Data

US 2008/0016773 A1 Jan. 24, 2008

(30) Foreign Application Priority Data

Jun. 15, 2006 (IT) ..... TO2006A0434

(51) Int. Cl.
*E05D 15/52* (2006.01)

(52) U.S. Cl. ..... 49/192; 49/193; 292/32; 292/43

(58) Field of Classification Search ..... 49/192, 49/193, 382, 400; 292/32, 38, 42, 43, 141, 292/145, 150
See application file for complete search history.

(56) References Cited

U.S. PATENT DOCUMENTS 3,994,093 A * 11/1976 Mayer et al. ..... 49/192
4,420,905 A * 12/1983 Kucharczyk ..... 49/192
4,637,165 A * 1/1987 Schneider ..... 49/192
4,679,352 A * 7/1987 Bates ..... 49/192
4,739,583 A * 4/1988 Tonsmann et al. ..... 49/192
6,421,877 B1 * 7/2002 Mih ..... 16/238

FOREIGN PATENT DOCUMENTS

EP 1 227 207 7/2002
EP 1 447 505 8/2004

OTHER PUBLICATIONS

EP Search Report, Application No. EP 06 42 5583, dated Sep. 27, 2007.

* cited by examiner

*Primary Examiner*—Katherine W Mitchell
*Assistant Examiner*—Catherine A Kelly
(74) *Attorney, Agent, or Firm*—Patterson & Sheridan, L.L.P.

(57) ABSTRACT

Drive assembly for door and window frames, comprising at least one actuating member and at least one transmission rod fastened to the actuating member, The transmission rod comprises a central portion and two lateral portions positioned at opposite sides relative to the central portion and forming two channel-shaped longitudinal guides, the central portion having a longitudinal groove positioned between the longitudinal guides, the longitudinal groove of the central portion being closed by a base. The transmission member has a connecting portion including two longitudinal ribs with ends shaped in such a way as to establish a telescopic coupling with the longitudinal guides of the transmission rod and a central portion positioned between said ribs and provided with a threaded hole in which is inserted a screw having a tip that is able to cut a hole in the base of the transmission rod at said longitudinal groove.

11 Claims, 12 Drawing Sheets

DRIVE ASSEMBLY FOR DOOR AND WINDOW FRAMES

CROSS-REFERENCE TO RELATED APPLICATIONS

This application claims benefit of Italian patent application number TO2006A000434, filed Jun. 15, 2006, which is herein incorporated by reference.

BACKGROUND OF THE INVENTION

1. Field of the Invention

The present invention relates to accessories for door and window frames and in particular to a drive assembly for door frames with wing and swivel opening or for frames with wing opening only or with swivel opening only.

2. Description of the Related Art

In the case of frames with wing and swivel opening, the drive assembly enables selectively to activate a closed position, a wing opening position and a swivel opening position, under the command of a cremone bolt handle with three positions. In the case of frames with only wing or swivel opening, the drive assembly enables selectively to activate a closed position and an open position, under the command of a cremone bolt handle with two positions.

In the remainder of the description and in the claims, "drive assembly" means the set of devices and components that allow to transmit the opening/closing motion from the handle to the various closure elements. The drive assembly for door and window frames comprises at least one actuating member and at least one transmission rod fastened to the actuating member.

Door and window frames have variable widths and heights, whilst actuating members are standard components with defined dimensions. To adapt the actuating members to frames with different dimensions, transmission rods are used which connect various actuating members to each other. The lengths of the actuating rods are determined when mounting the drive assembly on the door or window frame. This operation generally requires cutting the transmission rod to measure and drilling holes on the transmission rod for fastening the transmission rod to the actuating members.

Cutting the rods to measure and forming fastening holes on the transmission rods is highly time consuming. Previously, solutions have been proposed having the purpose of avoiding cutting the transmission rods to measure and forming fastening holes on said rods. Some solutions provide for the use of telescopic rods formed by two mutually sliding parts, able to be fastened in a selected position by means of pressure screws.

However, currently available solutions are not completely satisfactory, as they have several drawbacks.

SUMMARY OF THE INVENTION

The object of the present invention is to provide an improved system for the connection between the transmission rods and the actuating members of a drive assembly for door and window frames, which enables to overcome the drawbacks of prior art solutions.

According to the present invention, said object is achieved by a drive assembly for door and window frames having the characteristics set out in claim 1.

BRIEF DESCRIPTION OF THE DRAWINGS

The present invention shall now be described in detail with reference to the accompanying drawings provided purely by way of non limiting example, in which.

DETAILED DESCRIPTION

Figure 1:
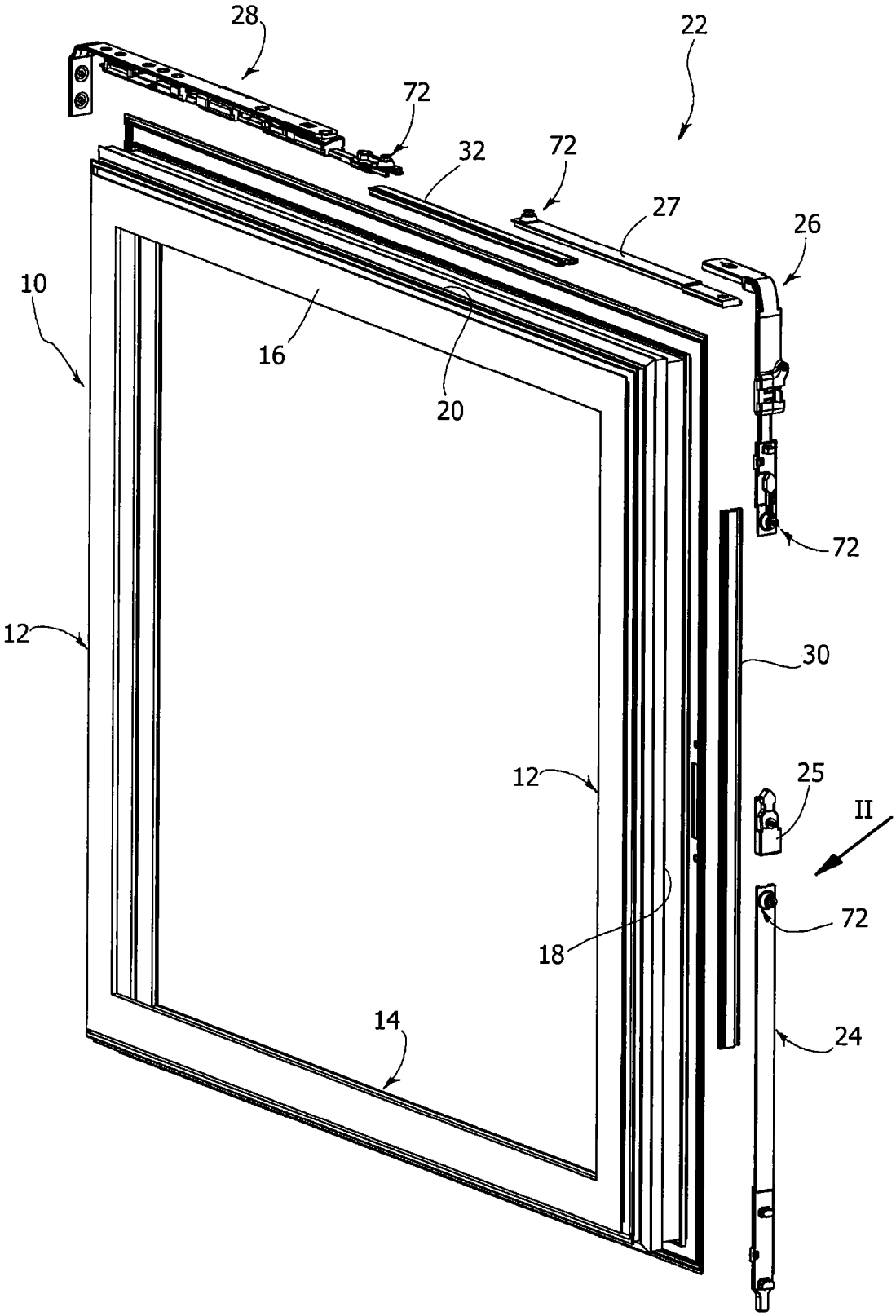
FIG. 1 is an exploded perspective view of a drive assembly for door and window frames associated to the frame of a door or window.

With reference to FIG. 1, the number 10 designates the frame of a window with wing and swivel opening. The frame 10 comprises two vertical uprights 12 joined together by a lower cross member 14 and by an upper cross member 16. The uprights 12 and the cross members 14, 16 are provided on their outer longitudinal side with slots 18, 20 able to receive the components of a drive assembly that enables to select, by means of a handle (not shown), a closed position, a wing opening position and a swing opening position.

In FIG. 1, the drive assembly globally designated by the reference 22, comprises a plurality of actuating members 24, 25, 26, 27, 28 and a plurality of transmission rods 30, 32. The actuating members shown in FIG. 1 are, respectively, a vertical fulcrum 24, a cremone bolt 25, an angled transmission element 26, a cursor 27 and a scissors arm 28. The general structure and the operation of the actuating members 24, 25, 26, 27, 28 are known in themselves and they are outside the scope of the present invention. The most relevant aspect of the present invention is the way in which the actuating members 24, 25, 26, 27, 28 are fastened to the transmission rods 30, 32.

Figure 4:
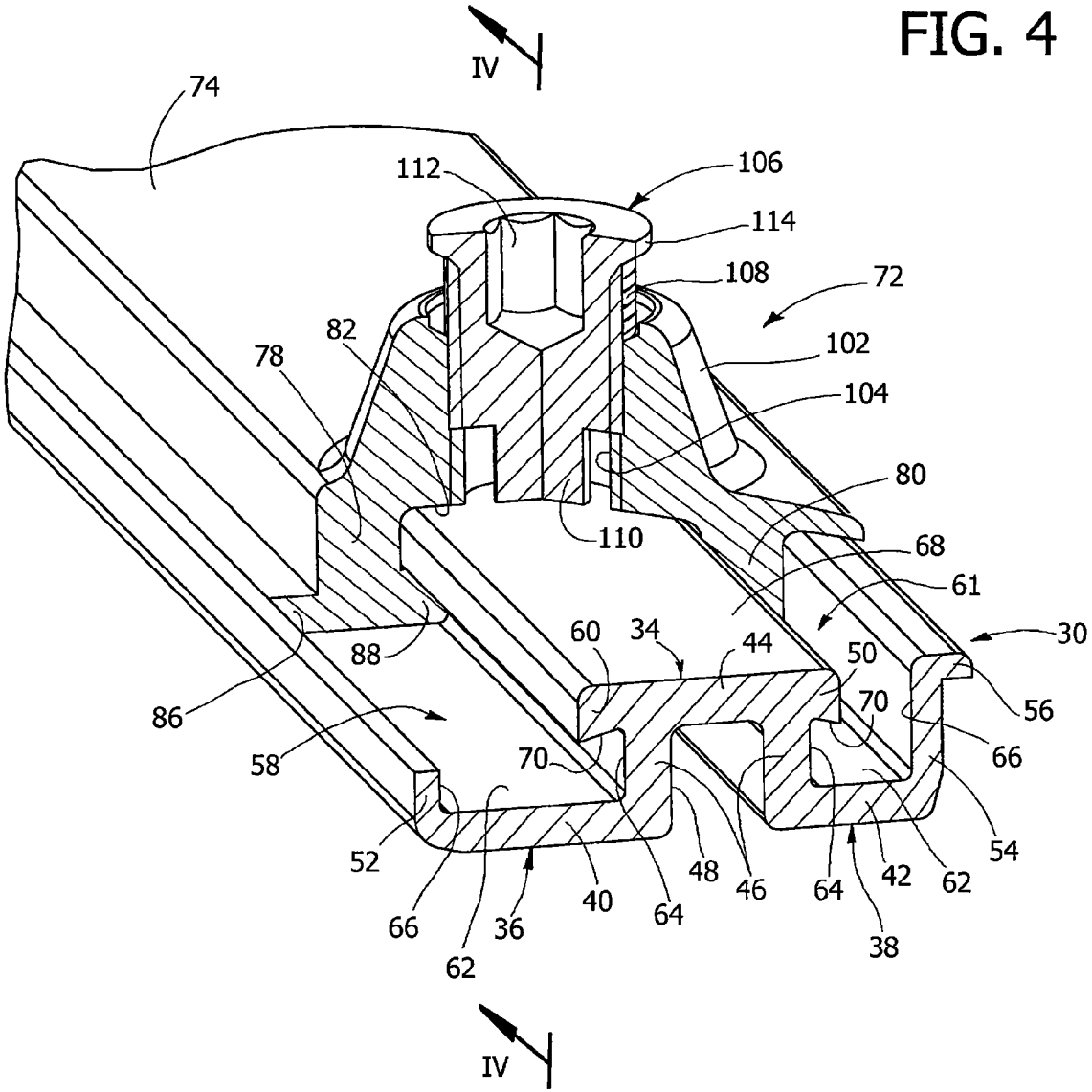
FIGS. 4*a* and 5*a* are sections according to the lines IV-IV and V-V of FIGS. 4 and 5, FIGS. 4*b* and 5*b* are enlarged details of the parts designated by the arrows IV and V in FIGS. 4*a* and 5*a*, FIGS. 6*a*, 7*a* and 8*a* are sections according to the lines VIa-VIa, VIIa-VIIa and VIIIa-VIIIa of FIGS. 6, 7 and 8, and FIGS. 6*b*, 7*b* and 8*b* are sections according to the lines VIb-VIb, VIIb-VIIb, VIIIb-VIIIb of FIGS. 6, 7 and 8.
Figure 4B:
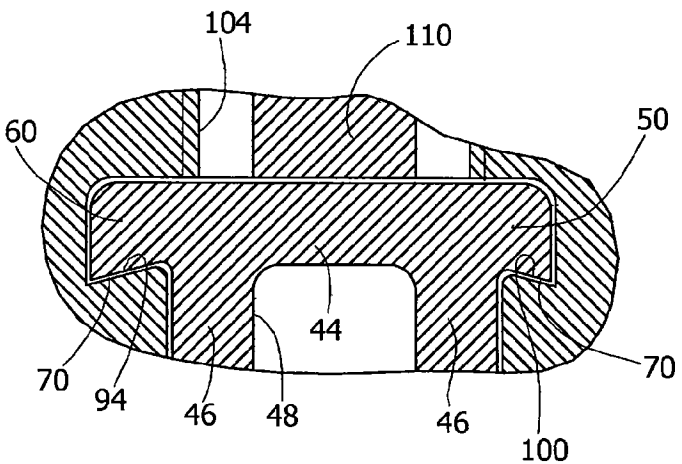
Figure 4A:
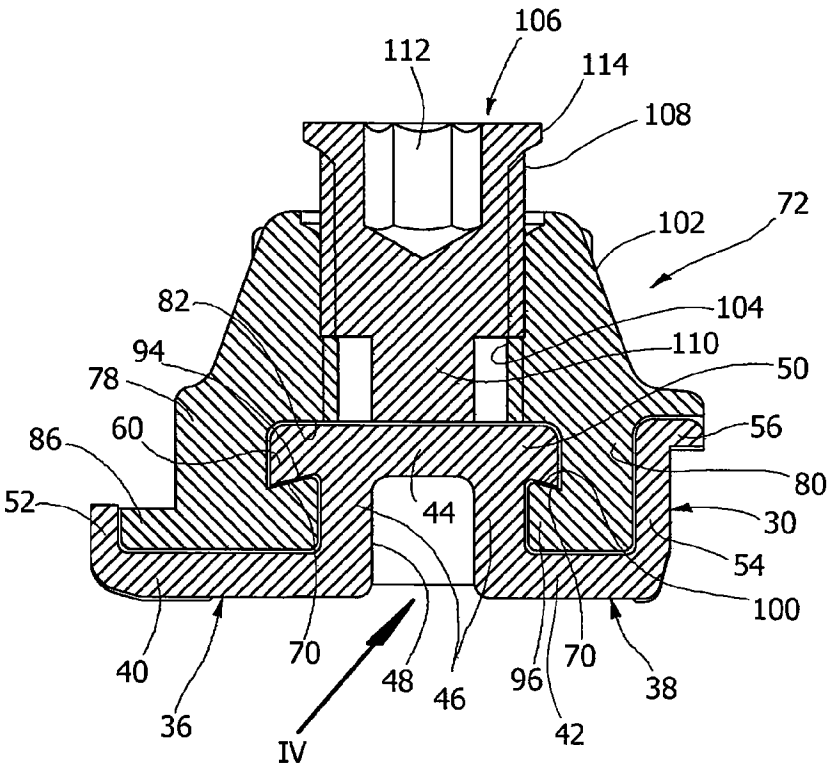

With reference to FIGS. 4 and 4*a*, each transmission rod 30, 32 is constituted by an extruded, drawn or profiled element having constant cross section.

Each transmission rod 30, 32 comprises a central portion 34 and two lateral portions 36, 38 situated at opposite parts relative to the central portion 34. The two lateral portions 36, 38 have respective mutually co-planar bases 40, 42. The central portion 34 has a base 44 that is parallel and distanced from the bases 40, 42 of the lateral portions 36, 38. The base 44 of the central portion 34 is connected to the respective bases 40, 42 of the lateral portions 36, 38 by means of two longitudinal ribs 46. The base 44 of the central portion 34 and the ribs 46 form a "U" shaped longitudinal groove 48 that extends along the central portion 34 and that separates the two lateral portions 36, 38. The central portion 34 has two lateral extensions 50 and 60 that extend externally beyond the ribs 46. The two bases 40, 42 of the lateral portions 36, 38 have at their outer ends respective longitudinal ribs 52, 54. The height of the rib 52 of the lateral portion 36 is about half the height of the ribs 46. The rib 54 of the lateral portion 38 ends at the same height as the base 44 of the central portion 34 and it has a laterally projecting edge 56.

The two lateral portions 36, 38 form respective channel-shaped guides 58, 61. Each of the two guides 58, 61 has an upper surface 62 and two lateral surfaces 64, 66. The central portion 34 has an upper surface 68 that is parallel to the upper surfaces 62 of the guides 58, 61. The lateral extensions 50, 60 of the central portion 34 have lower surfaces 70 inclined at an acute angle relative to the lateral surfaces 64 of the ribs 46. The thickness of the bases 40 of the lateral portions 36, 38 of the ribs 46 and of the base of the central portion 34 is substantially constant. The rods 30, 32 are preferably made of metallic material (e.g., aluminium alloy) or polyamide.

Figure 3:
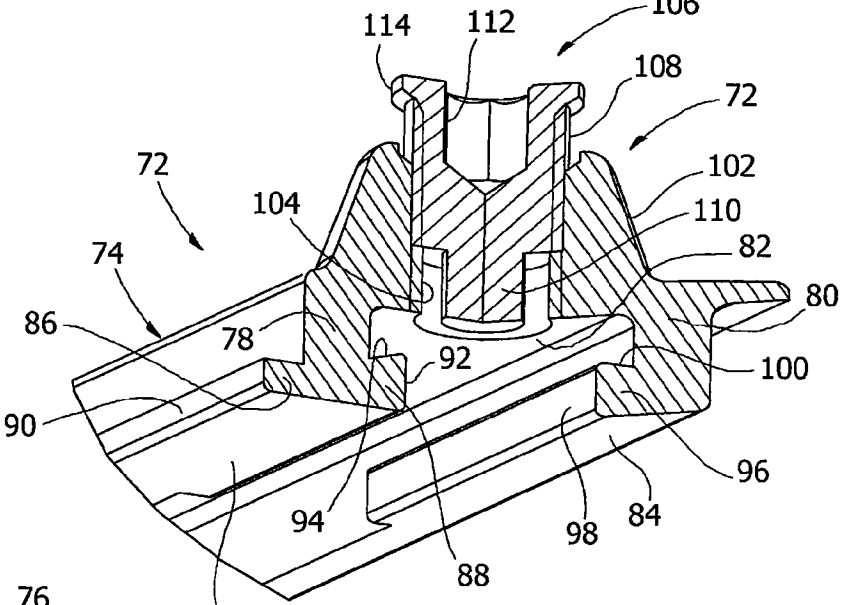
FIG. 3 is a section according to the line III-III of FIG. 2, FIGS. 4 through 8 are perspective view showing the sequence of the fastening operation between a drive member and a transmission rod.
Figure 2:
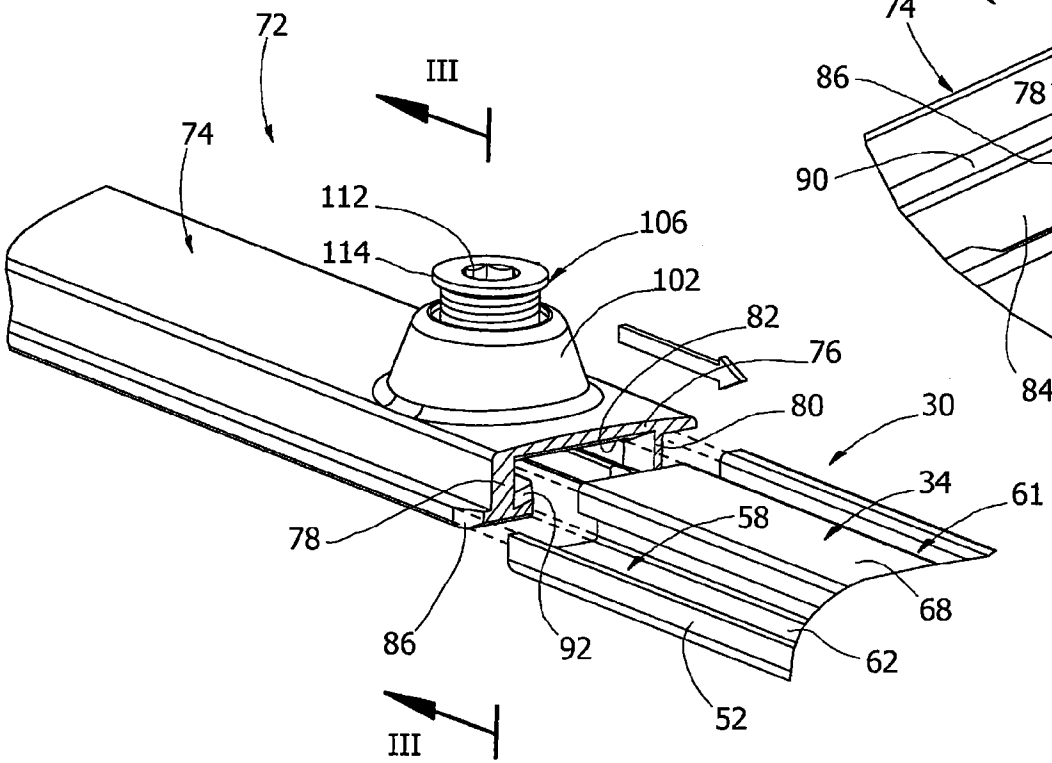
FIG. 2 is a perspective view of the part designated by the reference II in FIG. 1.

With reference to FIG. 1, each actuating member 24, 25, 26, 27, 28 has a coupling portion 72 for coupling with a transmission rod 30, 32. With reference to FIGS. 2 and 3, the coupling portion 72 of each actuating member 24, 25, 26, 27, 28 comprises a body 74 having a base 76 wherefrom project two parallel longitudinal ribs 78, 80. The ends of the longitudinal ribs 78, 80 are shaped in such a way as to establish a sliding coupling in longitudinal direction with the guides 58, 61 of the transmission rod 30, 32.

With reference again to FIGS. 2 and 3, the base 76 of the connecting portion 72 has a flat lower surface 82 wherefrom extend the ribs 78, 80. The lower ends of the ribs 78, 80 have respective coplanar flat surfaces 84, parallel to the flat surface 82. When cross sectioned, the longitudinal rib 78 has at its end an outer lateral extension 86 and an inner lateral extension 88. The two lateral extensions 86, 88 have respective lateral parallel walls 90, 92, orthogonal relative to the surfaces 82, 84. The inner lateral extension 88 has an upper surface 94 inclined at an acute angle relative to the lateral wall 92. The longitudinal rib 80 has, in cross section, an inner lateral extension 96 with a lateral wall 98 parallel to the wall 92 and an upper surface 100 inclined at an acute angle relative to the lateral wall 98.

The connecting portion 72 of each actuating member 24, 25, 26, 27, 28 has a protuberance 102 projecting from the outer surface of the base 76. The protuberance 102 has a threaded through hole 104 with orthogonal axis relative to the inner surface 82 of the base 76. A screw 106 is engaged in the threaded hole 104. The screw 106 has a threaded body 108 and a tip 110 that projects from the threaded body 108. The tip 110 has a cylindrical shape and a smaller diameter than the diameter of the threaded body 108. The screw 106 has a hexagonal slot 112 and an arresting edge 114 at one end of the threaded body 108. The length of the threaded body 108 is substantially equal to the length of the threaded hole 104, so that when the screw 106 is completely screwed into the hole 104 the tip 110 projects from the lower surface 82 of the base 76.

With reference to FIGS. 4, 4*a* and 4*b*, the coupling portion 72 of each actuating member 24, 25, 26, 27, 28 couples in telescopic fashion with a corresponding portion of a transmission rod 30, 32. The screw 106 is only partially screwed in the hole 104, so that the front end of the tip is recessed in the hole 104 relative to the lower surface 82 of the connecting portion 72. The connecting portion 72 and the transmission rod 30, 32 are free to slide with respect to one another in longitudinal direction. To allow telescopic sliding between the two components, the respective coupling profiles are so dimensioned as to leave a constant play along the entire profile, e.g. in the order of 0.1 mm, as shown in particular in FIGS. 4*a* and 4*b*.

The actuating member 24, 25, 26, 27, 28 and the transmission rods 30, 32 are mounted in the respective slots 18 of the frame 10. The way in which the various components are inserted into the slots 18 is described in detail in a simultaneous patent application by the same Applicant.

After insertion into the slots 18, the relative position between the actuating members 24, 25, 26, 27, 28 and the transmission rods 30, 32 can be adjusted, thanks to a relative sliding in longitudinal direction made possible by the telescopic coupling.

After selecting the correct relative position between the actuating members 24, 25, 26, 27, 28 and the transmission rods 30, 32, actuating members 24, 25, 26, 27, 28 and the transmission rods 30, 32 are mutually fastened. Said fastening operation is accomplished by fully tightening the screws 106.

Figure 5:
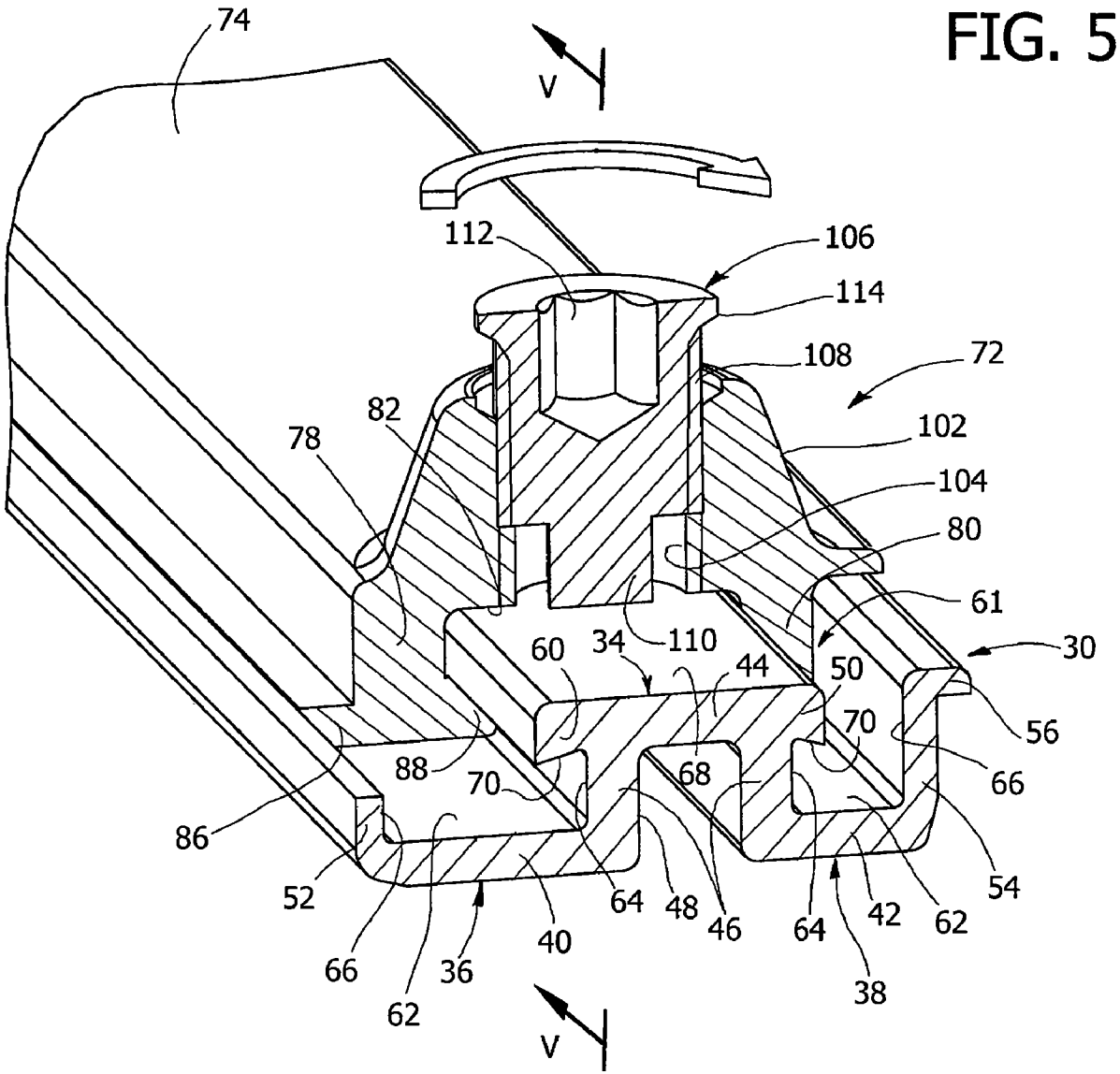
Figure 5B:
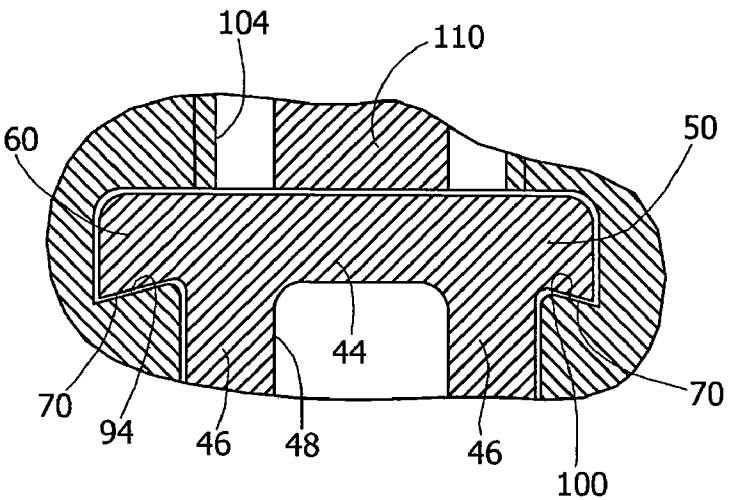
Figure 5A:
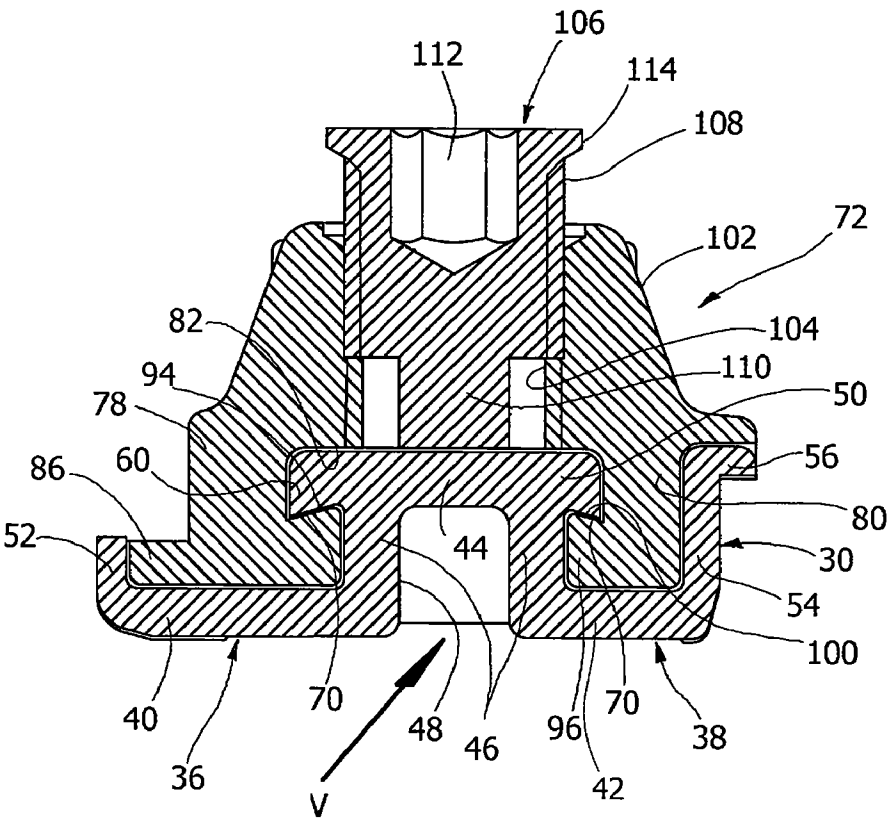

With reference to FIGS. 5, 5*a* and 5*b*, in the initial position the tip 110 of the screw 106 is slightly distanced from the upper surface 68 of the transmission rod 30, 32 and there is a play between the inclined surfaces 94, 100 of the coupling portion 72 and the corresponding surfaces 70 of the transmission rod 30, 32.

Beginning from the position shown in FIGS. 5, 5*a* and 5*b*, starting to tighten the screw 106 the tip 110 comes in contact with the upper surface 68 of the transmission rod 30, 32. This contact allows to eliminate the play of the telescopic coupling, bringing the inclined surfaces 94, 100 of the coupling portion 72 in contact with the corresponding surfaces 70 of the transmission rod 30, 32.

Figure 6:
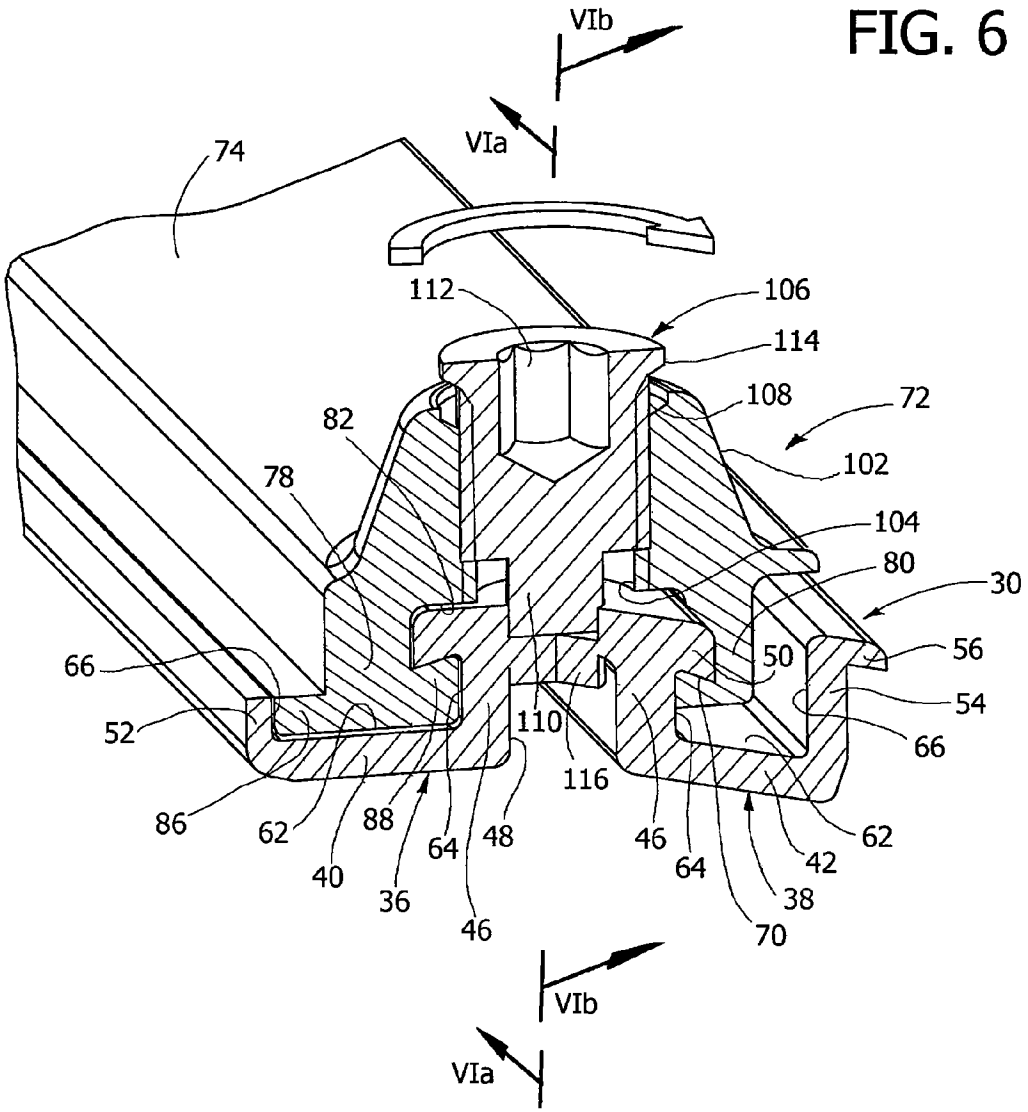
Figure 6B:
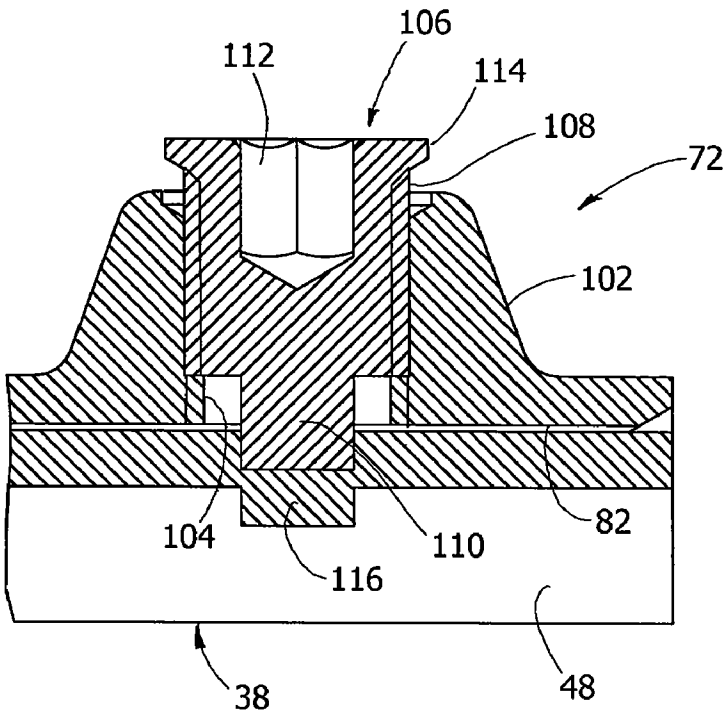
Figure 6A:
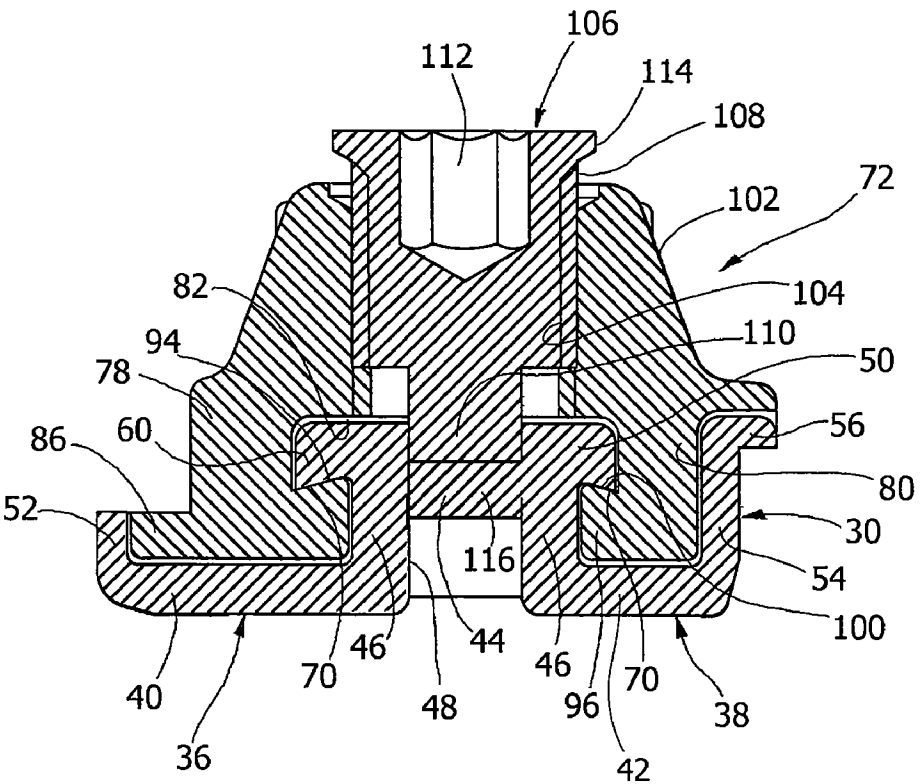

With reference to FIGS. 6, 6*a* and 6*b*, continuing to tighten the screw 106 the tip 110 starts to penetrate into the base 44 of the transmission rod 30, 32 cutting a hole into the material constituting the base 42. Said cutting forms a disc-shaped scrap 116 that projects in the channel 48 situated below the tip 110. The diameter of the tip 110 is slightly greater than the width of the groove 48, so that the scrap remains wedged in the groove 48. The tip 110 is situated with its own axis aligned to the median vertical axis of the groove 48. The shearing performed by the tip 110 of the screw 106 affects only the thickness of the base 44 between the two lateral walls of the longitudinal groove 48.

Figure 7:
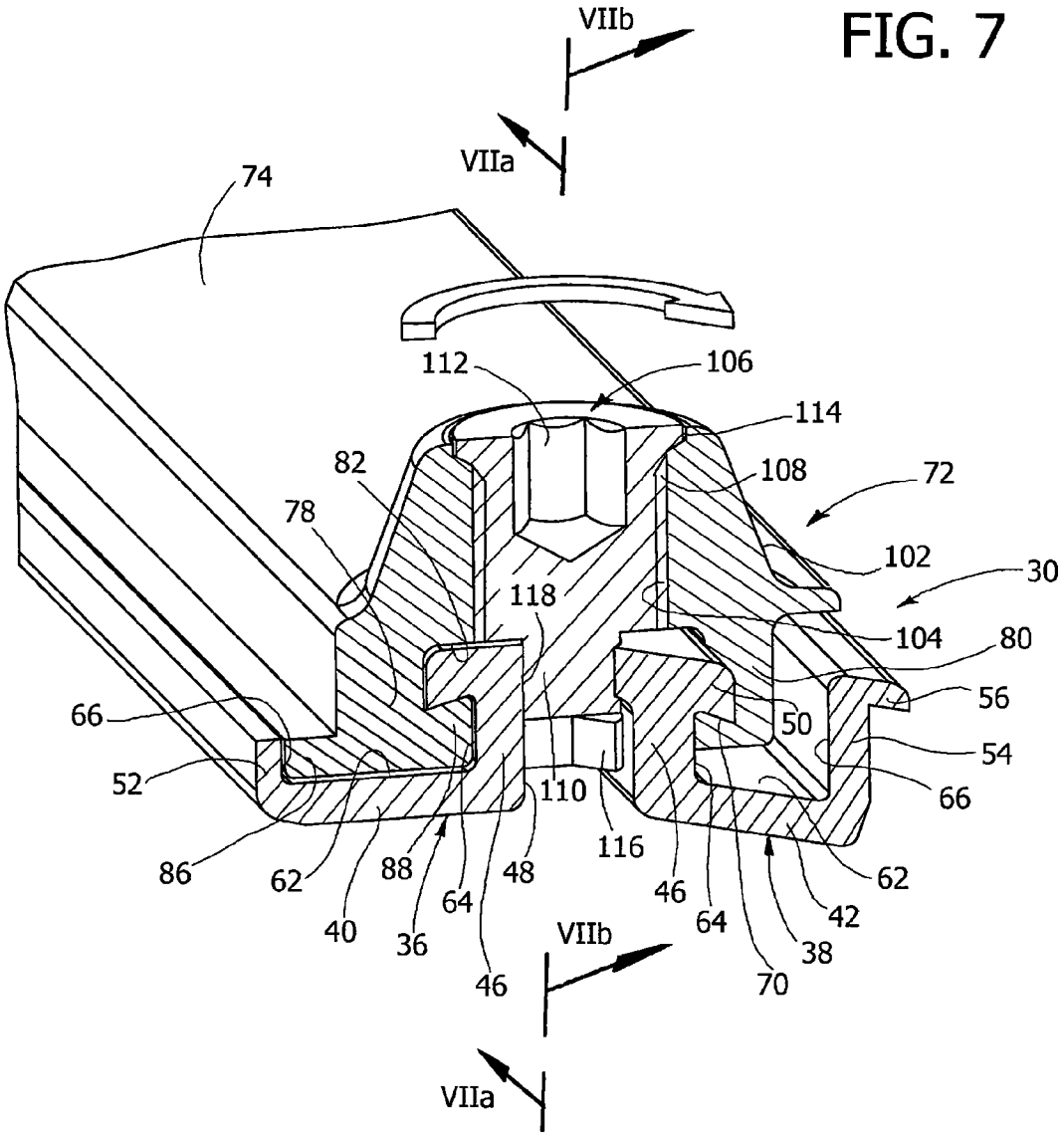
Figure 7B:
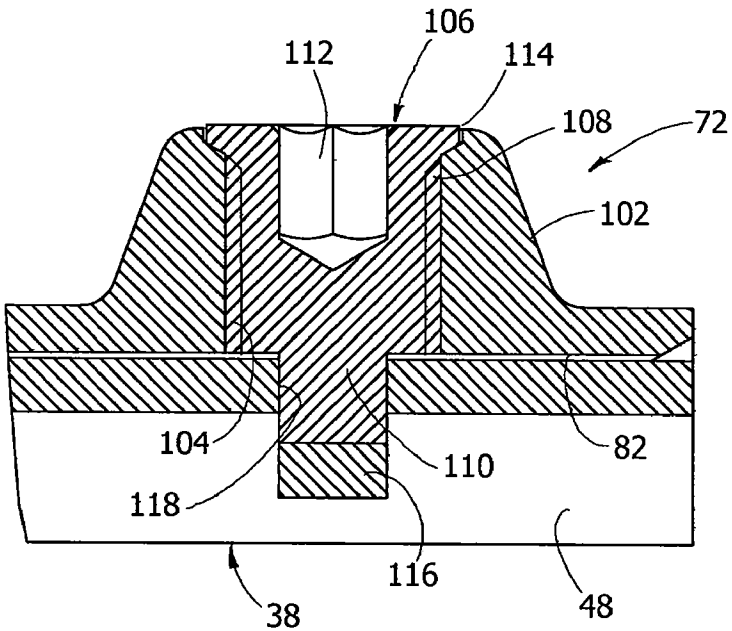
Figure 7A:
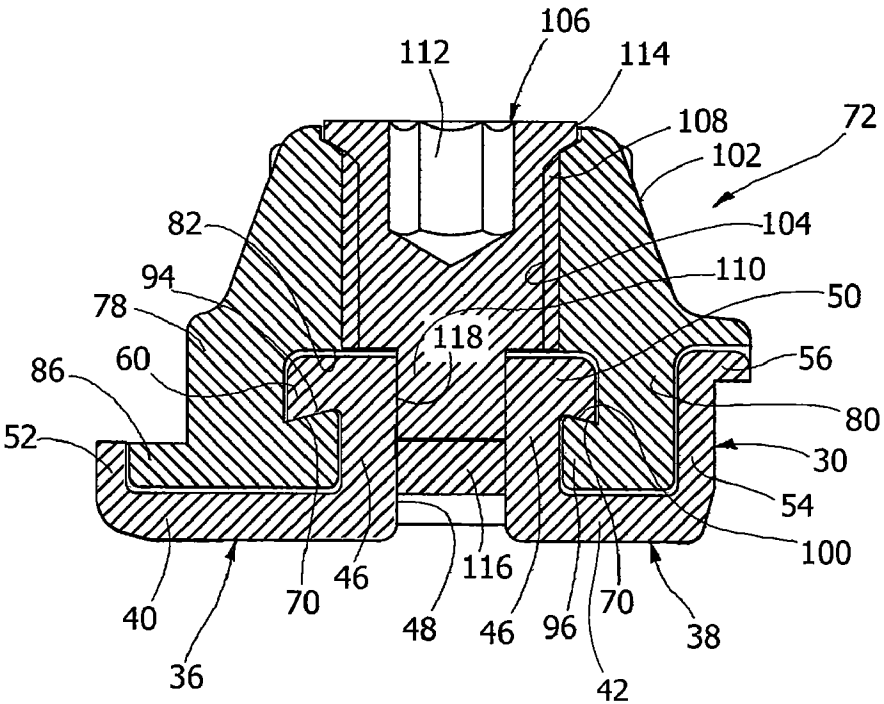

With reference to FIGS. 7, 7*a* and 7*b*, the screw 106 is tightened until the head 114 of the screw 106 abuts against the respective seat formed at the upper end of the protuberance 102.

The length of the tip 110 is determined in such a way that the screw 106 performs a complete shearing of the base 44, forming a through hole 118 in the base 44. The scrap 116 detaches from the base 44 and is held by interference between the walls of the groove 48.

Figure 8:
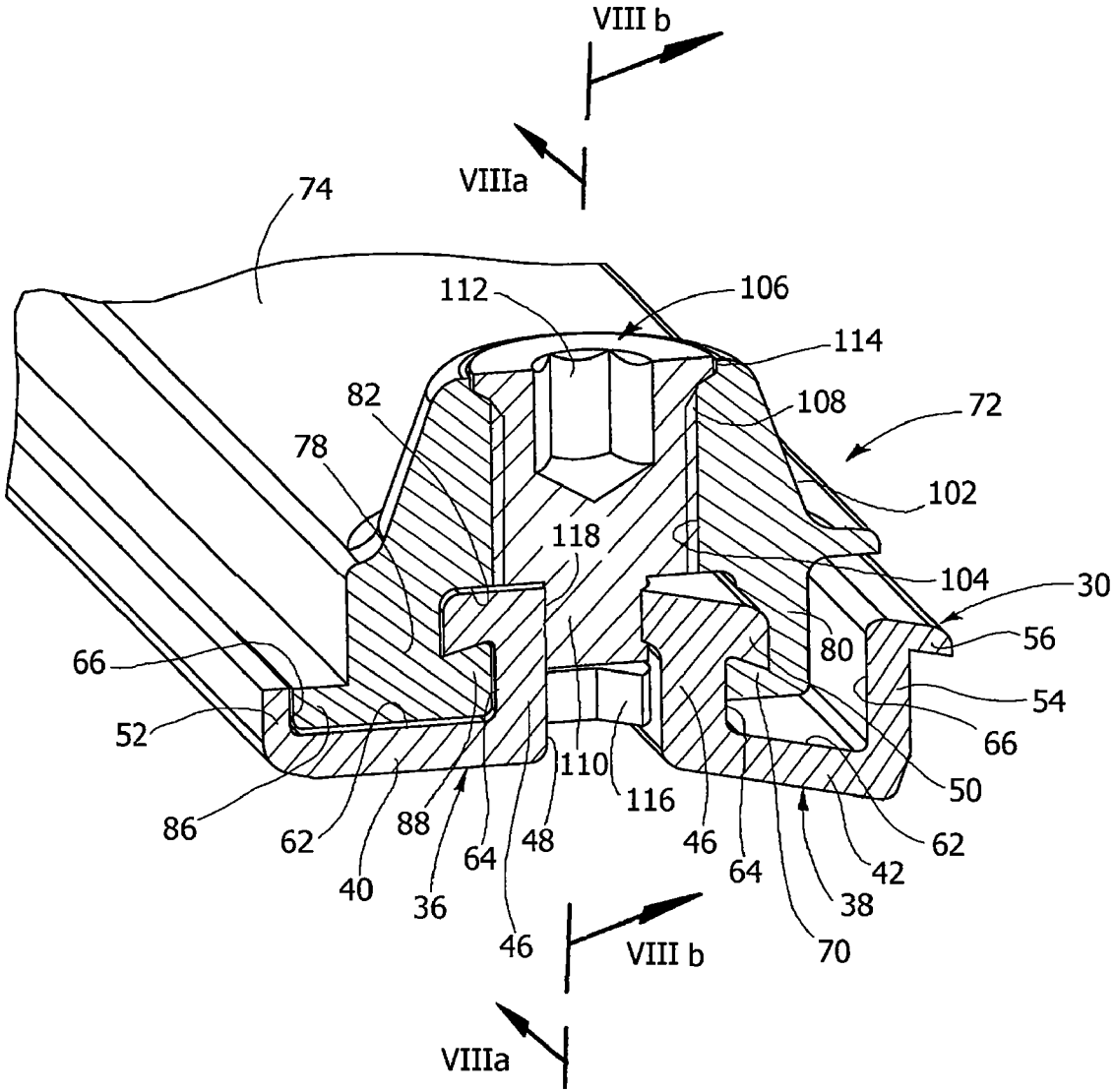
Figure 8B:
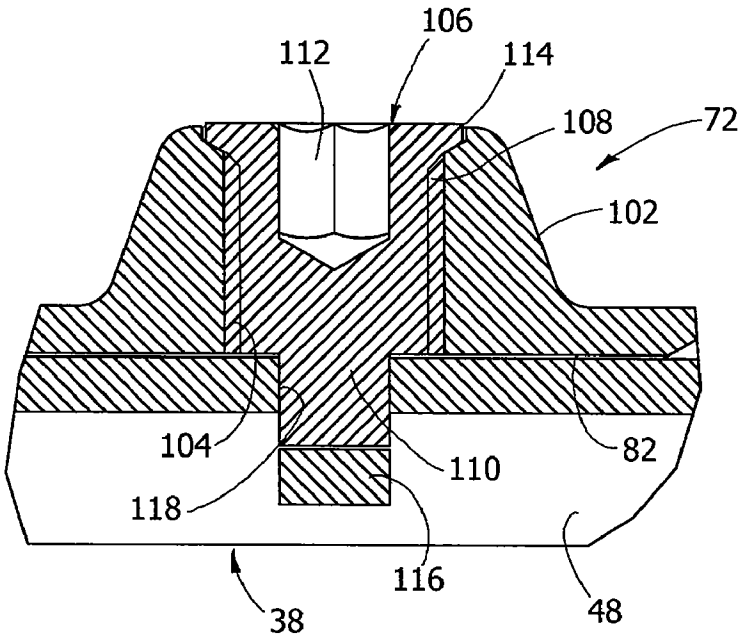
Figure 8A:
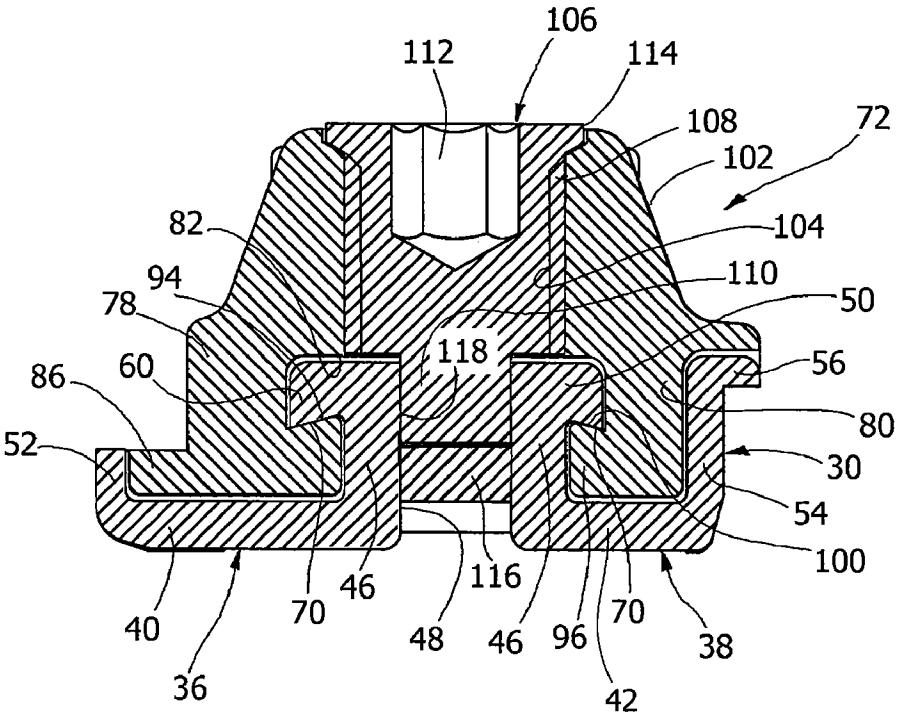

With reference to FIGS. 8*a* and 8*b*, after the complete cut of the wall of the base 44, the contact pressure between the inclined surfaces 94, 100 and 70 is eliminated. This allows to restore the initial play, eliminating the stresses and elastic deformations of the transmission rod 30, 32.

After the cut of the scrap 116, the connection between the coupling portion 72 and the transmission rod 30, 32 no longer takes place by friction but rather by pivot-hole coupling between the tip 110 of the screw 106 and the hole 118 created by effect of the shearing of the base 44.

This allows to have a more secure fastening than a friction connection and to eliminate deformations of the transmission rod which could cause interference with the walls of the groove 18 of the frame 10, creating difficulties with the sliding of the rods or of the actuating members and difficulties with the operation of the actuation assembly.

While the foregoing is directed to embodiments of the present invention, other and further embodiments of the invention may be devised without departing from the basic scope thereof, and the scope thereof is determined by the claims that follow.

The invention claimed is:

1. A drive assembly for door and window frames, comprising at least one actuating member and at least one transmission rod fastened to the actuating member, wherein:

the transmission rod comprises a central portion and two lateral portions positioned at opposite sides relative to the central portion and forming two channel-shaped longitudinal guides, the central portion having a longitudinal groove opening in a direction away from the actuating member positioned between the longitudinal guides, the longitudinal groove of the central portion being closed by a base, the central portion of the transmission rod comprises two longitudinal ribs connecting the base to the lateral portions, the central portion having moreover two lateral extensions extending externally beyond the longitudinal ribs, the actuating member has a coupling portion including two longitudinal ribs with ends shaped in such a way as to establish a telescopic coupling with said longitudinal guides of the transmission rod and a central portion positioned between said ribs and provided with a threaded hole in which is inserted a screw having a threaded body adapted for coupling with said threaded hole and a tip, that is able to cut a hole in the base of the transmission rod at said longitudinal groove, said tip protruding axially away from the threaded body and being non-threaded, and wherein the longitudinal ribs of the actuating member have respective inner lateral extensions, the lateral extensions of the transmission rod and the inner lateral extensions of the actuating member have respective surfaces that come into contact upon tightening of said screw.

2. The drive assembly as claimed in claim 1, wherein the tip of the screw as a result of its being completely screwed into the threaded hole forms the hole in the base.

3. The drive assembly as claimed in claim 1, wherein the formation of said through hole produces a scrap detached from the base and held between lateral walls of said longitudinal groove.

4. The drive assembly as claimed in claim 1, wherein the tip of said screw has a length that is equal to or greater than the thickness of said base.

5. The drive assembly as claimed in claim 4, wherein the diameter of the tip is equal to or greater than the width of said longitudinal groove of the transmission rod.

6. The drive assembly as claimed in claim 1, wherein the screw has an arresting edge able to enter in arresting relationship with a corresponding seat in the completely screwed condition.

7. The drive assembly as claimed in claim 1, wherein the threaded hole of said coupling portion is formed in a protuberance projecting from an outer surface of said coupling portion.

8. The drive assembly as claimed in claim 1, wherein each inner lateral extension includes a lateral wall and wherein the respective surface on each of the inner lateral extensions is inclined at an acute angle relative to the lateral wall.

9. The drive assembly as claimed in claim 8, wherein each longitudinal rib on the transmission rod includes a lateral surface and wherein the respective surface on the lateral extension is inclined at an acute angle relative to the lateral surface.

10. The drive assembly as claimed in claim 1, wherein the respective surface on each of the inner lateral extensions is inclined at an angle in a direction away from a bottom flat surface of each longitudinal rib on the actuating member.

11. The drive assembly as claimed in claim 10, wherein the respective surface on each lateral extension is inclined at an angle in a direction away from an upper surface of the central portion of the transmission rod.

* * * * *